US007156228B2

(12) United States Patent
Brizzi et al.

(10) Patent No.: US 7,156,228 B2
(45) Date of Patent: Jan. 2, 2007

(54) RIGID MINOR LATERAL WALL HINGED-LID PACKAGE OF TOBACCO ARTICLES AND BLANK

(75) Inventors: Marco Brizzi, Zola Predosa (IT); Marco Ghini, Monte San Pietro (IT)

(73) Assignee: G. D. Societa'per Azioni, Bologna (IT)

( * ) Notice: Subject to any disclaimer, the term of this patent is extended or adjusted under 35 U.S.C. 154(b) by 200 days.

(21) Appl. No.: 10/903,416

(22) Filed: Jul. 30, 2004

(65) Prior Publication Data

US 2005/0092625 A1 May 5, 2005

(30) Foreign Application Priority Data

Aug. 1, 2003 (IT) ..... BO2003A0469

(51) Int. Cl.
*B65D 85/10* (2006.01)
*B65D 43/16* (2006.01)

(52) U.S. Cl. ..... 206/268; 206/273; 229/160.1

(58) Field of Classification Search ..... 206/259, 206/265, 268, 271, 273; 229/160.1
See application file for complete search history.

(56) References Cited

U.S. PATENT DOCUMENTS 3,446,338 A 5/1969 Bozyk
5,174,492 A * 12/1992 Gero ..... 206/273
5,379,889 A * 1/1995 Cobler ..... 206/268
5,465,836 A * 11/1995 Focke ..... 206/268
5,586,648 A * 12/1996 Focke et al. ..... 206/273
5,651,454 A * 7/1997 Trimani ..... 206/273
5,806,671 A * 9/1998 Focke et al. ..... 206/268
6,302,322 B1 * 10/2001 Focke et al. ..... 229/160.1
6,457,580 B1 * 10/2002 Focke et al. ..... 206/268
6,715,605 B1 * 4/2004 Manservigi et al. ..... 206/268

FOREIGN PATENT DOCUMENTS

DE 29 40 421 4/1981
EP 0 928 751 7/1999
WO WO 03/008302 1/2003

* cited by examiner

*Primary Examiner*—Bryon P. Gehman
(74) *Attorney, Agent, or Firm*—Marshall, Gerstein & Borun LLP

(57) ABSTRACT

A rigid package of tobacco articles, having a container, in turn having an open top end closed by a hinged lid, and a collar fixed to the inside of the container to project partly outwards of the open top end; the container is substantially parallelepiped-shaped, and has two end walls, and a lateral surface which is bounded by the end walls and has two, respectively front and rear, minor lateral walls, and two major lateral walls; a hinge of the lid is located on the front minor lateral wall; the container is formed by folding a flat blank substantially in the form of an elongated rectangle; and the collar is formed by joining two separate portions, at least one of which is joined to the blank along a respective preformed fold line.

22 Claims, 6 Drawing Sheets

RIGID MINOR LATERAL WALL HINGED-LID PACKAGE OF TOBACCO ARTICLES AND BLANK

CROSS-REFERENCE TO RELATED APPLICATION

This application claims the benefit of Italian Patent Application Serial No. BO2003A 000469, filed Aug. 1, 2003.

The present invention relates to a rigid, hinged-lid package of tobacco articles, and to the relative blank.

The present invention may be used to advantage for producing a rigid, hinged-lid cigarette packet, to which the following description refers purely by way of example.

BACKGROUND OF THE INVENTION

A rigid, hinged-lid cigarette packet normally comprises a cup-shaped bottom container having an open top end; and a cup-shaped top lid hinged to the bottom container along a hinge to rotate, with respect to the bottom container, between an open position and a closed position respectively opening and closing the open end of the bottom container. When the lid is in the closed position, the packet is substantially parallelepiped-shaped, and comprises two, respectively top and bottom, end walls; a lateral surface bounded by the end walls and defined by two major lateral walls and two minor lateral walls; four longitudinal edges, each defined between a major lateral wall and a minor lateral wall; four major transverse edges, each defined between an end wall and a major lateral wall; and four minor transverse edges, each defined between an end wall and a minor lateral wall. The lid hinge is normally formed on a major lateral wall, and is parallel to the major transverse edges. This is by far the most widely marketed configuration, and therefore the one for which most packing machines for producing rigid packets of cigarettes are designed.

Rigid, hinged-lid cigarette packets have also been proposed, in which the lid hinge is formed on a minor lateral wall or on the top end wall, and is parallel to the minor transverse edges. Though not widely marketed, this configuration nevertheless appears to be popular with consumers. Known packets with the lid hinge parallel to the minor transverse edges, e.g. as described in U.S. Pat. No. 5,957,280 A1, WO-9935056-A1, U.S. Pat. No. 2,848,153 A1, U.S. Pat. No. 3,446,338 A1, U.S. Pat. No. 2,944,726, and DE-2940421-A1, however, must be produced on specially designed packing machines, or involve major alterations to existing packing machines designed to produce rigid packets of cigarettes with the hinge lid parallel to the major transverse edges.

SUMMARY OF THE INVENTION

It is an object of the present invention to provide a rigid, hinged-lid package of tobacco articles, designed to eliminate the aforementioned drawbacks, and which at the same time is cheap and easy to produce.

According to the present invention, there is provided a rigid, hinged-lid package of tobacco articles, as claimed in Claim 1 and, preferably, in any one of the following Claims depending directly or indirectly on Claim 1.

According to the present invention, there is also provided a rigid, hinged-lid package of tobacco articles, as claimed in Claim 20.

According to the present invention, there is also provided a blank for producing a rigid, hinged-lid package of tobacco articles, as claimed in Claim 22 or in any one of the following Claims depending directly or indirectly on Claim 22.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 2:
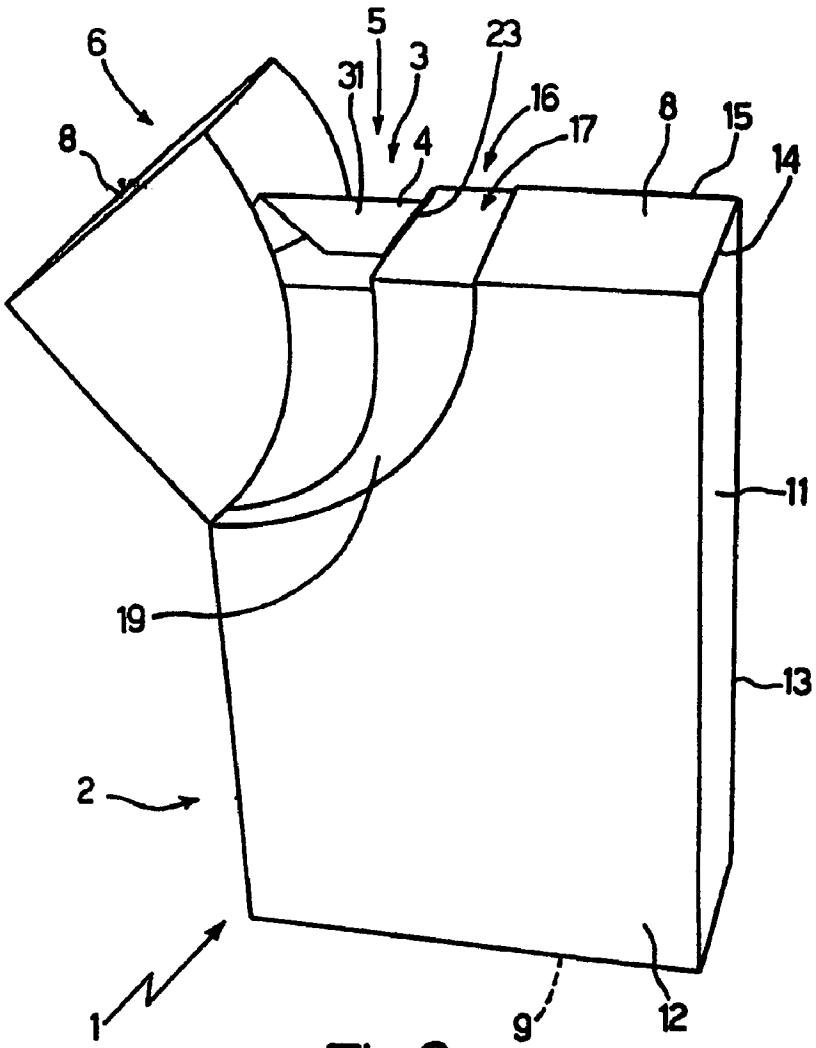
FIG. 2 shows a front view in perspective of the FIG. 1 packet of cigarettes in an open configuration.
Figure 1:
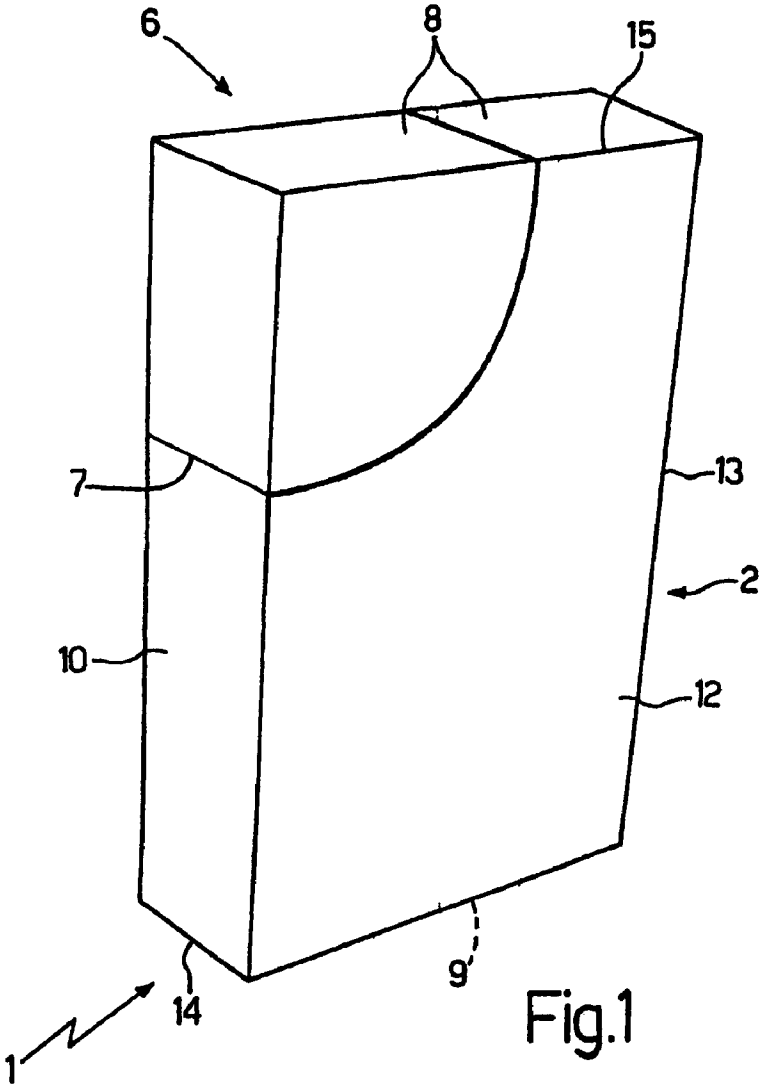
FIG. 1 shows a view in perspective of a packet of cigarettes in accordance with the present invention and in a closed configuration.

Number 1 in FIG. 1 indicates as a whole a rigid packet of cigarettes, comprising a cup-shaped container 2; and a substantially parallelepiped-shaped group 3 of cigarettes wrapped in a foil wrapping 4 and housed inside container 2. Container 2 comprises an open top end 5; and a cup-shaped lid 6 hinged to container 2 along a hinge 7 to rotate, with respect to container 2, between an open position (FIG. 2) and a closed position (FIG. 1) respectively opening and closing open top end 5.

When lid 6 is in the closed position, container 2 is in the form of a substantially rectangular parallelepiped defined by a lateral surface, and by two flat, identical, parallel, facing end walls 8 and 9, respectively a top wall 8 and a bottom wall 9, bounding the lateral surface. The lateral surface comprises two flat, facing, parallel minor lateral walls 10 and 11; and two flat, facing major lateral walls 12 crosswise to minor lateral walls 10 and 11. More specifically, one minor lateral wall 10 defines a front wall of container 2, and the other minor lateral wall 11 defines a rear wall of container 2. Container 2 comprises four longitudinal edges 13, each defined between a major lateral wall 12 and a minor lateral wall 10 or 11; four minor transverse edges 14, each defined between an end wall 8 or 9 and a minor lateral wall 10 or 11; and four major transverse edges 15, each defined between an-end wall 8 or 9 and a major lateral wall 12.

As shown in the accompanying drawings, hinge 7 is located on front wall 10-and parallel to minor transverse edges 14, so that lid 6 comprises part of top wall 8; of front wall 10, and of major lateral walls 12.

Packet 1 also comprises a collar 16, which is fixed (glued) inside container 2 to project partly outwards of open top end 5 and engage a corresponding inner surface of lid 6 when lid 6 is in the closed position (shown in FIG. 1).

Figure 3:
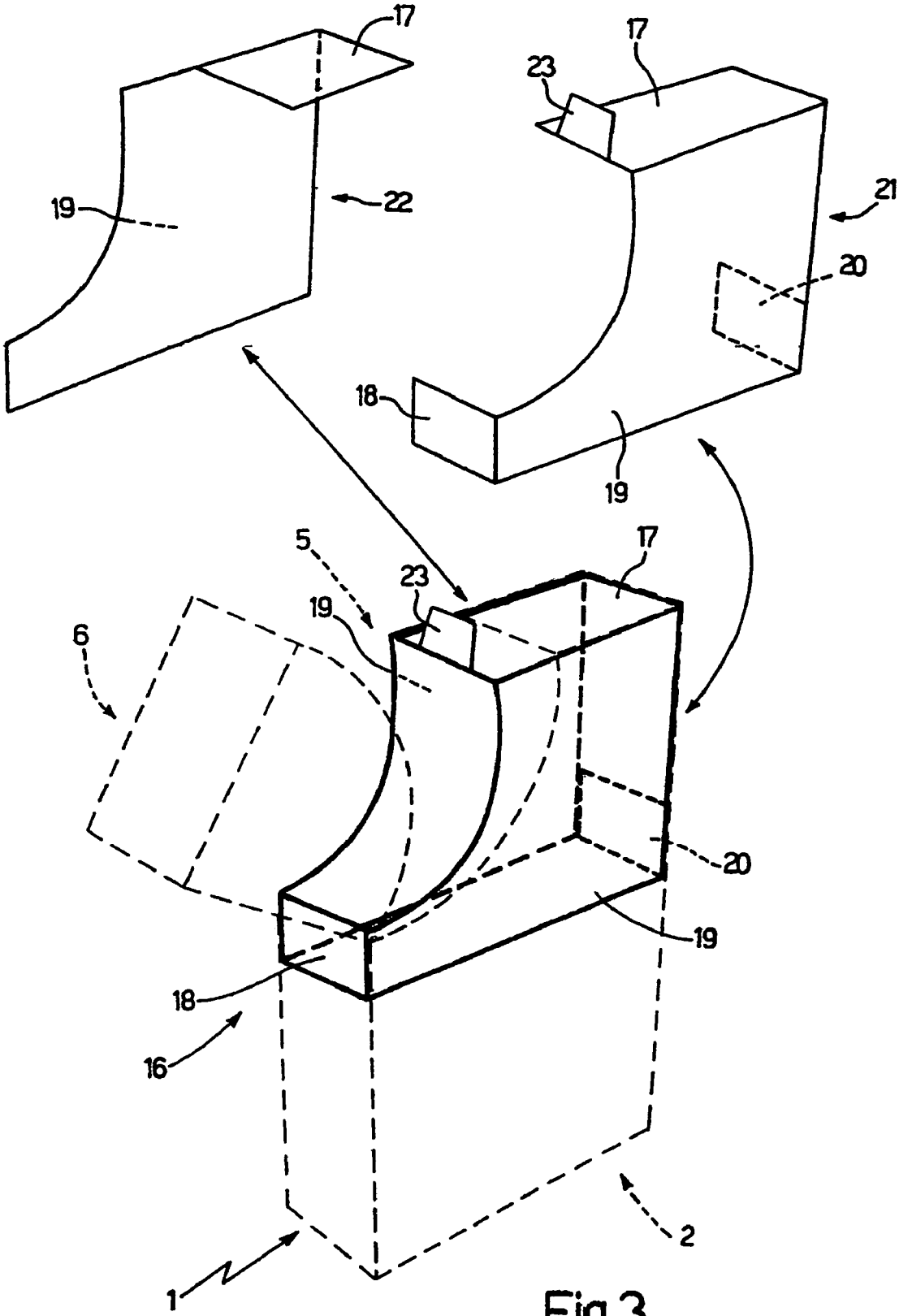
FIG. 3 shows a view in perspective, with parts removed for clarity, of the FIG. 1 packet of cigarettes in an open configuration.
Figure 4:
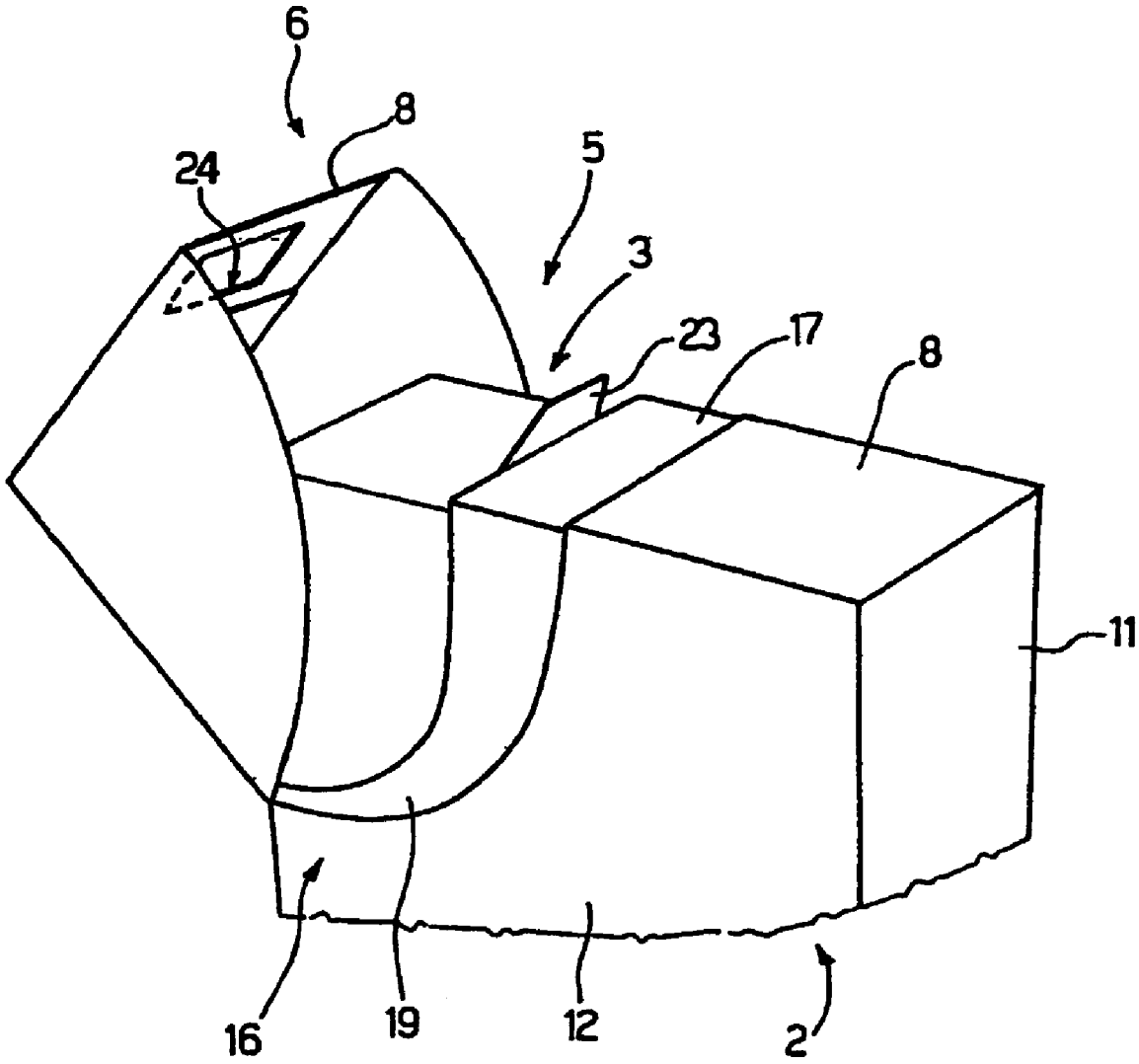
FIG. 4 shows a larger-scale view in perspective of a detail of the FIG. 1 packet of cigarettes.

As shown in FIG. 3, collar 16 comprises a top wall 17 which contacts top wall 8 of container 2; a front wall 18 which contacts front wall 10 of container 2; two lateral walls 19, each of which contacts a respective major lateral wall 12 of container 2; and a rear wall 20 which contacts rear wall 11 of container 2. It is important to note that collar 16 comprises two separate portions 21 and 22, which are independent of each other when forming container 2.

The portion of top wall 17 of collar 16 projecting outwards of open top end 5 has a retaining tab 23 which engages the inner surface of top wall 8 of lid 6, when lid 6 is in the closed position, to hold lid 6 in the closed position with a given closing force. For which purpose, a seat 24 is formed on the inner surface of top wall 8 of lid 6 to receive retaining tab 23 in known manner, when lid 6 is in the closed position, and so increase the closing force. More specifically, retaining tab 23 is in the form of an isosceles trapezium with the major base joined to top wall 17 of collar 16, and seat 24 is rectangular.

As shown in the accompanying drawings, the portion of each lateral wall 19 of collar 16 projecting from open top end 5 of container 2 is bounded by a curved line having the same curvature as the edge of lid 6.

In an alternative embodiment not shown, the portion of each lateral wall 19 of collar 16 projecting from open top end 5 of container 2 is bounded by a straight line or a broken line; and similarly, the edge of lid 6 may also be bounded by a straight line or a broken line.

Figure 5:
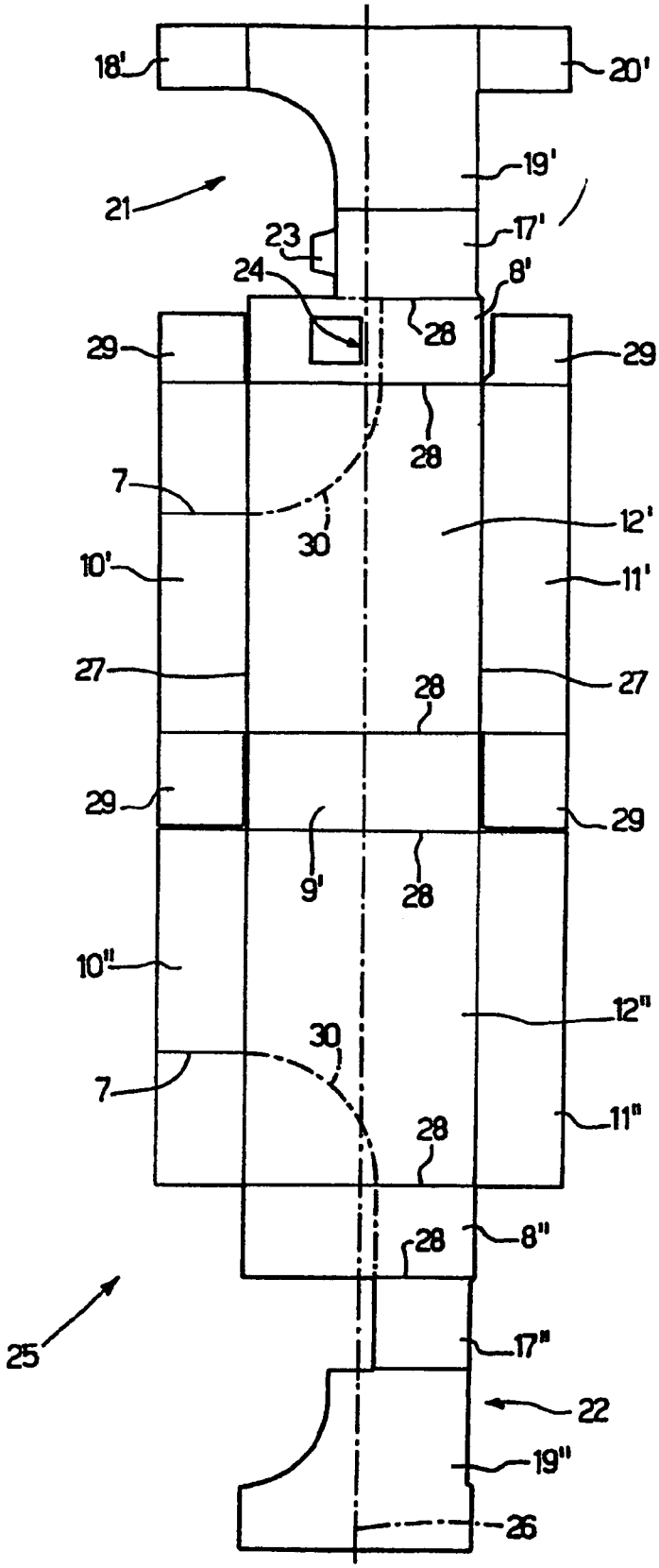
FIG. 5 shows a spread-out view of a blank used to produce the FIG. 1 packet of cigarettes.

As shown in FIG. 5, container 2 is formed from a corresponding flat blank 25, which is substantially in the form of an elongated rectangle, and the parts of which are indicated, wherever possible, using the same reference numbers, but with superscripts, as for the corresponding parts of container 2.

Blank 25 (which has a central longitudinal axis 26) comprises two preformed longitudinal fold lines 27; and a number of preformed transverse fold lines 28 defining, between the two preformed longitudinal fold lines 27, a panel 8' forming part of top end wall 8, a panel 12' forming one major lateral wall 12, a panel 9' forming bottom end wall 9, a panel 12" forming the other major lateral wall 12, and a panel 8" forming another part of top end wall 8. Panels 12' and 12" each have two wings 10',11' and 10", 11", which are located on opposite sides of relative panels 12' and 12", are separated from relative panels 12' and 12" by preformed longitudinal fold lines 27, and define front wall 10 and rear wall 11. Each wing 10', 11' of panel 12' has longitudinal appendixes 29 located at opposite ends of wing 10', 11' and which form respective inner portions of end walls 8 and 9.

Each wing 10', 10" has a preformed fold line forming part of hinge 7. And two tear lines 30 are formed, one on panels 8' and 12' and one on panels 8" and 12", define the open top end 5 of container 2, are torn when first opening lid 6, and define the parting-line between lid 6 and container 2.

Blank 25 also comprises portion 21 of collar 16, which is joined to panel 8' along a respective preformed transverse fold line 28; and portion 22 of collar 16, which is joined to panel 8" along a respective preformed transverse fold line 28. Portion 21 of collar 16 comprises a panel 17' forming part of top wall 17 of collar 16; a panel 19' forming one lateral wall 19 of collar 16; and two tabs 18' and 20' located on opposite sides of panel 19' and which form front wall 18 and rear wall 20 of collar 16. Portion 22 of collar 16 comprises a panel 17" forming another part of top wall 17 of collar 16; and a panel 19" forming the other lateral wall 19 of collar 16.

To form container 2, portions 21 and 22 of collar 16 are first folded 180° *about respective preformed transverse fold lines 28 onto the rest of blank 25, so that panels 19' and 19" of collar 16 contact panels 12' and 12" respectively, panels 17' and 17" of collar 16 contact panels 8' and 8" respectively, and tabs 18' and 10, 20' of collar 16 contact wings 10' and 11' respectively. Glue is preferably interposed between portions 21 and 22 of collar 16 and the rest of blank 25, so as to keep portions 21 and 22 of collar 16 in position contacting the rest of blank 25, once portions 21 and 22 of collar 16 are folded 180° about respective preformed transverse fold lines 28 as described above. More specifically, glue is preferably applied between panels 17' and 8' and between panels 17" and 8".

It is important to note that portions 21 and 22 of collar 16 may be folded 180° about respective preformed transverse fold lines 28 as described above on a packing machine to which blanks 25 are fed perfectly flat, or before blanks 25 are fed to the packing machine.

Blank 25 is then folded about group 3 of cigarettes to form container 2 in known conventional manner, in that, once portions 21 and 22 of collar 16 are folded 180° about respective preformed transverse fold lines 28, blank 25 assumes the form of a standard blank that can be processed by a standard packing machine with no alterations required. That is, portions 21 and 22 of collar 16 being positioned contacting the rest of blank 25, the elements of portions 21 and 22 of collar 16 are folded together with and when folding the other elements of blank 25.

Another important point to note is that portion 21 of collar 16 being joined to blank 25 ensures precise positioning of portion 21 with respect to the rest of blank 25 once portion 21 is folded 180°, thus ensuring, in particular, precise engagement of seat 24 (on panel 8' of blank 25) by retaining tab 23 (on portion 21 of collar 16).

Figure 6:
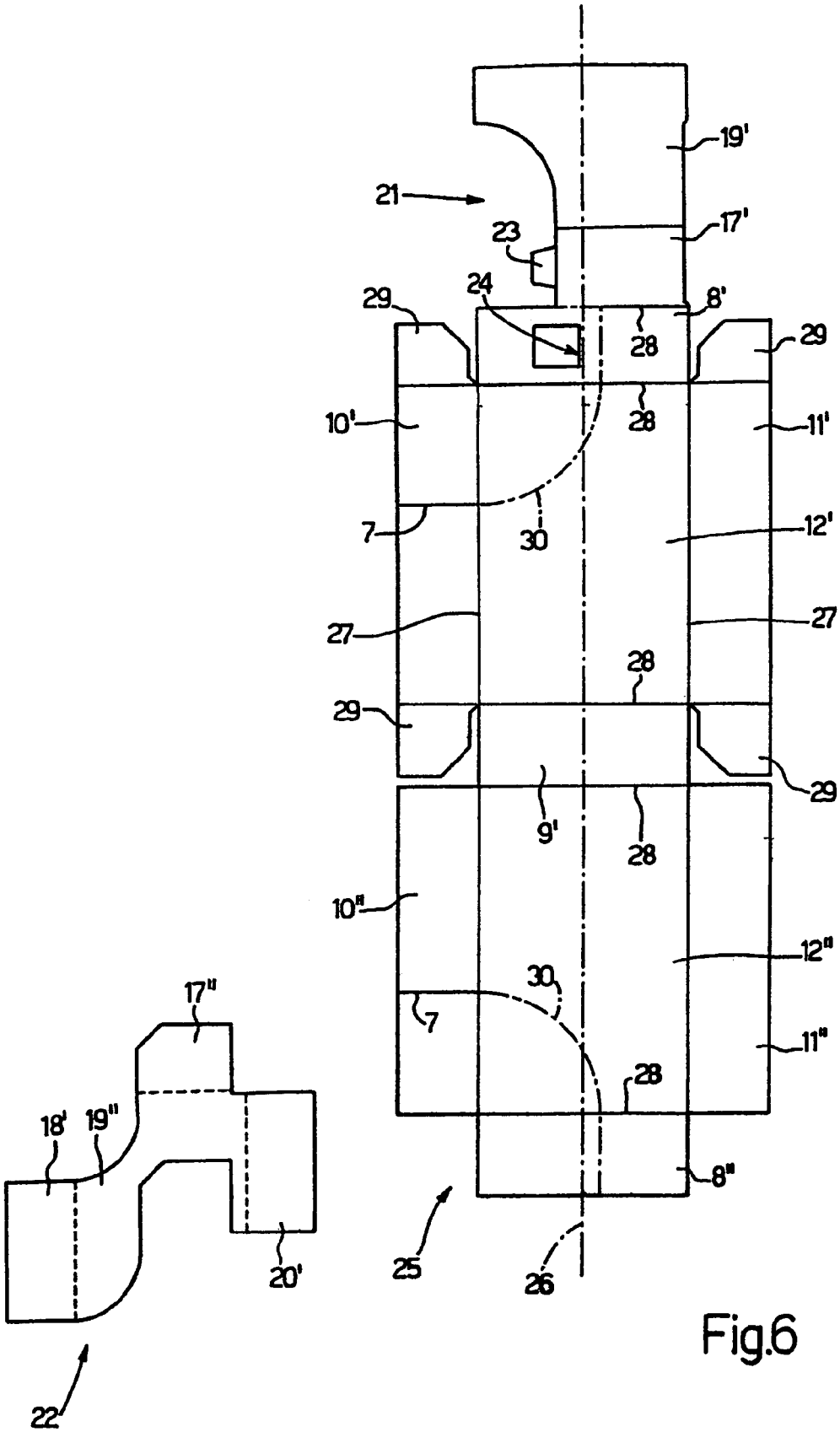
FIG. 6 shows a spread-out view of an alternative embodiment of a blank used to produce the FIG. 1 packet of cigarettes.

In an alternative embodiment shown in FIG. 6, blank 25 comprises portion 21 of collar 16, which is joined to panel 8' along a respective preformed transverse fold line 28, whereas portion 22 of collar 16 is separate from blank 25. In this embodiment, portion 21 of collar 16 is first folded 180° about respective preformed transverse fold line 28, whereas portion 22 of collar 16 is applied to group 3 of cigarettes, and is connected to blank 25 when group 3 of cigarettes, together with portion 22 of collar 16, is engaged by blank 25.

As shown in FIG. 6, portion 21 of collar 16 comprises a panel 17' forming part of top wall 17 of collar 16; and a panel 19' forming one lateral wall 19 of collar 16. And portion 22 of collar 16 comprises a panel 17" forming another part of top wall 17 of collar 16; a panel 19" forming the other lateral wall 19 of collar 16; and two tabs 18' and 20' located on opposite sides of panel 19" and forming front wall 18 and rear wall 20 of collar 16.

Figure 7:
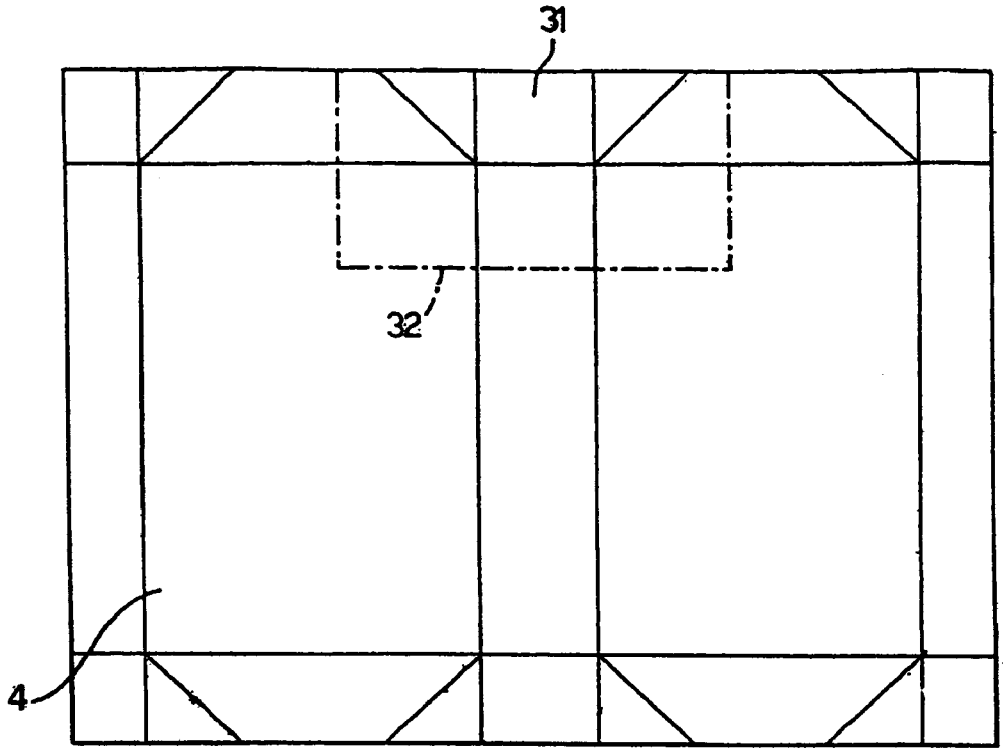
FIGS. 7 and 8 show two alternative embodiments of a sheet of foil wrapping used to wrap a group of cigarettes housed inside the FIG. 1 packet of cigarettes.
Figure 8:
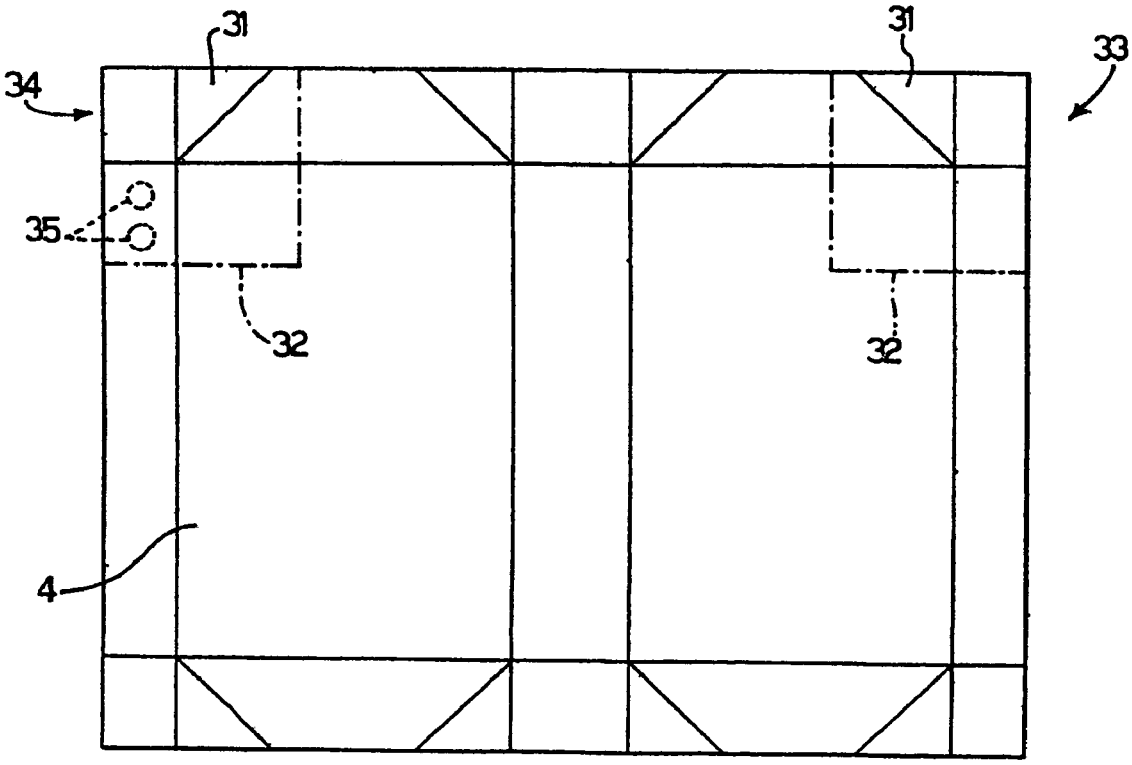

As shown in FIGS. 7 and 8, foil wrapping 4 enclosing group 3 of cigarettes is rectangular, and is detached from a continuous strip (not shown) of foil. FIGS. 7 and 8 show the fold lines along which foil wrapping 4 is folded about group 3 of cigarettes; and foil wrapping 4 comprises a removable portion 31 bounded with respect to the rest of wrapping 4 by a tear line 32, and which is torn off to extract the cigarettes (not shown in detail).

Tear line 32 may be formed by a single incision in the centre of wrapping 4 (as shown in FIG. 7), or by two separate incisions at two opposite ends of wrapping 4 (as shown in FIG. 8). When tear line 32 is formed by two separate incisions at two opposite ends of wrapping 4 (as shown in FIG. 8), removable portion 31 comprises two portions 33 and 34 which overlap once wrapping 4 is folded completely; and at least one drop 35 of glue is preferably applied between portions 33 and 34, to join portions 33 and 34 and enable simultaneous removal of both portions 33 and 34 by the user.

In the accompanying drawings, edges 13, 14, 15 of container 2 are all square edges. In alternative embodiments not shown, some of the edges of container 2 may be bevelled or rounded, as described in Patent Applications WO-03024839-A1, EP-0764594-A1, EP-0764595-A1, WO-0115999-A1 or EP-0205766-A1.

In the accompanying drawings, the walls of container 2 are all flat walls. In alternative embodiments not shown, at least one wall of container 2 is outwardly convex, as described in Patent Applications EP-0941943-A1, WO-0043289-A1 or WO-03026984-A1.

Given the numerous advantages of packet 1 of cigarettes as described above, the form of packet 1 may be reproduced integrally to form other types of rigid containers of tobacco articles, such as a carton of packets of cigarettes. More specifically, a carton of packets of cigarettes is substantially similar to packet 1 as described above, the only difference being that, as opposed to group 3 of cigarettes, it contains a group of packets of cigarettes (normally of the same form as the carton).

The invention claimed is:

1. A rigid package of tobacco articles (3), having a container (2) which houses the tobacco articles (3) and comprises an open top end (5), a lid (6) hinged to the container (2) along a hinge (7) to rotate, with respect to the container (2), between an open position and a closed position respectively opening and closing the open top end (5), and a collar (16) fixed to the inside of the container (2) to project partly outwards of the open top end (5) and engage a corresponding inner surface of the lid (6) when the lid (6) is in the closed position; the container (2) being substantially parallelepiped-shaped, and having two, respectively top and bottom, end walls (8, 9), and a lateral surface which is bounded by the end walls (8, 9) and comprises two, respectively front and rear, minor lateral walls (10, 11), and two major lateral walls (12); the hinge (7) being located on the front minor lateral wall (10), and being parallel to minor transverse edges (14) defined between the end walls (8, 9) and the minor lateral walls (10, 11); and the container (2) being formed by folding a flat blank (25) in the form of substantially an elongated rectangle; the package (1) being characterized in that the collar (16) is formed by joining two separate portions (21, 22), at least one of which is joined to the blank (25) along a respective preformed fold line (28).

2. A package as claimed in claim 1, wherein the blank (25) comprises two preformed longitudinal fold lines (27), and a number of preformed transverse fold lines (28) defining, between the two preformed longitudinal fold lines (27), a first panel (8') forming part of the top end wall (8), a second panel (12') forming one said major lateral wall (12), a third panel (9') forming the bottom end wall (9), a fourth panel (12") forming the other said major lateral wall (12), and a fifths panel (8") forming another part of the top end wall (8); a first portion (21) of the collar (16) being joined to the first panel (8') along a respective said preformed transverse fold line (28).

3. A package as claimed in claim 2, wherein a second portion (22) of the collar (16) is separate from the blank (25).

4. A package as claimed in claim 3, wherein the first portion (21) of the collar (16) is folded 180° about its respective preformed transverse fold line (28) onto the rest of the blank (25).

5. A package as claimed in claim 4, wherein the first portion (21) of the collar (16) is joined by glue to the rest of the blank (25).

6. A package as claimed in claim 2, wherein a second portion (22) of the collar (16) is joined to the fifth panel (8") along a respective said preformed transverse fold line (28).

7. A package as claimed in claim 6, wherein the first and second portions (21, 22) of the collar (16) are folded 180° about their respective preformed transverse fold lines (28) onto the rest of the blank (25).

8. A package as claimed in claim 7, wherein the first and second portions (21, 22) of the collar (16) are joined by glue to the rest of the blank (25).

9. A package as claimed in claim 2, wherein the second and fourth panels (12'; 12") each comprise two wings (10', 11'; 10", 11"), which are located on opposite sides of the relative second and fourth panels (12'; 12"), are separated from the relative second and fourth panels (12'; 12") by the preformed longitudinal fold lines (27), and form the front wall (10) and the rear wall (11); each wing (10'; 11') of the second panel (12') having longitudinal appendices (29) located at opposite ends of the wing (10'; 11') and forming respective inner portions of the end walls (8, 9).

10. A package as claimed in claim 2, wherein two tear lines (30) are formed, one on the first and second panels (8', 12'), and one on the fourth and fifth panels (12", 8"), define the open top end (5) of the container (2), are torn when first opening the lid (6), and define a parting line between the lid (6) and the container (2).

11. A package as claimed in claim 2, wherein the collar (16) comprises a top wall (17) which contacts the top wall (8) of the container (2); a front wall (18) which contacts the front wall (10) of the container (2); and two lateral walls (19), each of which contacts a respective said major lateral wall (12) of the container (2).

12. A package as claimed in claim 11, wherein the collar (16) comprises a rear wall (20) which contacts the rear wall (11) of the container (2).

13. A package as claimed in claim 12, wherein the first portion (21) of the collar (16) comprises a sixth panel (17') forming part of the top wall (17) of the collar (16); a seventh panel (19') forming one said lateral wall (19) of the collar (16); and two tabs (18', 20') located on opposite sides of the seventh panel. (19') and forming the front wall (18) and the rear wall (20) of the collar (16); and the second portion (22) of the collar (16) comprises an eighth panel (17") forming another part of the top wall (17) of the collar (16); and a ninth panel (19") forming the other said lateral wall (19) of the collar (16).

14. A package as claimed in claim 12, wherein the first portion (21) of the collar (16) comprises a sixth panel (17') forming part of the top wall (17) of the collar (16); and a seventh panel (19') forming one said lateral wall (19) of the collar (16); and the second portion (22) of the collar comprises an eighth panel (17") forming another part of the top wall (17) of the collar (16); a ninth panel (19") forming the other said lateral wall (19) of the collar (16); and two tabs (18', 20') located on opposite sides of the ninth panel (19") and forming the front wall (18) and the rear wall (20) of the collar (16).

15. A package as claimed in claim 1, wherein the collar (16) comprises a top wall (17) which contacts the top wall (8) of the container (2), and which comprises, on a portion projecting outwards of the open top end (5), a retaining tab (23) which engages an inner surface of the top wall (8) of the lid (6) when the lid (6) is in said closed position, so as to keep the lid (6) in the closed position with a given closing force.

16. A package as claimed in claim 15, wherein a seat (24) is formed in the inner surface of the top wall (8) of the lid (6) to receive the retaining tab (23) when the lid (6) is in said closed position.

17. A package as claimed in claim 1, wherein the tobacco articles (3) are wrapped in an inner wrapping (4) having a removable tear-off portion (31) bounded with respect to the rest of the inner wrapping (4) by a tear line (32).

18. A package as claimed in claim 17, wherein the tear line (32) is defined by a single incision in the centre of the inner wrapping (4).

19. A package as claimed in claim 17, wherein the tear line (32) is defined by two separate incisions at two opposite ends of the inner wrapping (4), and comprises two portions (33, 34) which overlap once the inner wrapping (4) is folded completely, and are glued together.

20. A rigid package of tobacco articles (3), having a container (2) which houses the tobacco articles (3) and comprises an open top end (5), a lid (6) hinged to the container (2) along a hinge (7) to rotate, with respect to the container (2), between an open position and a closed position respectively opening and closing the open top end (5), and a collar (16) fixed to the inside of the container (2) to project partly outwards of the open top end (5) and engage a corresponding inner surface of the lid (6) when the lid (6) is in the closed position; the container (2) being substantially parallelepiped-shaped, and having two, respectively top and bottom, end walls (8, 9), and a lateral surface which is bounded by the end walls (8, 9) and comprises two, respectively front and rear, minor lateral walls (10, 11), and two major lateral walls (12); the hinge (7) being located on the front minor lateral wall (10), and being parallel to minor transverse edges (14) defined between the end walls (8, 9) and the minor lateral walls (10, 11); and the container (2) being formed by folding a flat blank (25) in the form of substantially an elongated rectangle; the package (1) being characterized in that the collar (16) comprises a top wall (17) which contacts the top wall (8) of the container (2), and which comprises, on a portion projecting outwards of the open top end (5), a retaining tab (23) which engages an inner surface of the top wall (8) of the lid (6) when the lid (6) is in said closed position, so as to keep the lid (6) in the closed position with a given closing force.

21. A package as claimed in claim 20, wherein a seat (24) is formed in the inner surface of the top wall (8) of the lid (6) to receive the retaining tab (23) when the lid (6) is in said closed position.

22. A flat blank (25), in the form of substantially an elongated rectangle, for producing a rigid package (1) of tobacco articles (3) as claimed in claim 1; the package (1) having a container, (2) which houses the tobacco articles (3) and comprises an open top end (5), a lid (6) hinged to the container (2) along a hinge (7) to rotate, with respect to the container (2), between an open position and a closed position respectively opening and closing the open top end (5), and a collar (16) fixed to the inside of the container (2) to project partly outwards of the open top end (5) and engage a corresponding inner surface of the lid (6) when the lid (6) is in the closed position; the container (2) being substantially parallelepiped-shaped, and having two, respectively top and bottom, end walls (8, 9), and a lateral surface which is bounded by the end walls (8, 9) and comprises two, respectively front and rear, minor lateral walls (10, 11), and two major lateral walls (12); the hinge (7) being located on the front minor lateral wall (10), and being parallel to minor transverse edges (14) defined between the end walls (8, 9) and the minor lateral walls (10, 11); and the blank (25) being characterized in that the collar (16) is formed by joining two separate portions (21, 22), at least one of which is joined to the blank (25) along a respective preformed fold line (28).

* * * * *

UNITED STATES PATENT AND TRADEMARK OFFICE

CERTIFICATE OF CORRECTION

PATENT NO. : 7,156,228 B2
APPLICATION NO. : 10/903416
DATED : January 2, 2007
INVENTOR(S) : Marco Brizzi et al.

It is certified that error appears in the above-identified patent and that said Letters Patent is hereby corrected as shown below:

On the Title Page:

At line (54), "RIGID MINOR LATERAL WALL HINGED-LID PACKAGE OF TOBACCO ARTICLES AND BLANK" should be -- RIGID HINGED-LID PACKAGE OF TOBACCO ARTICLES AND RELATIVE BLANK --.

Title Page, Item (73) Assignee: "G.D. Societa'per Azioni" should be -- G.D Societa' per Azioni --.

At Column 1, lines 1-3, "RIGID MINOR LATERAL WALL HINGED-LID PACKAGE OF TOBACCO ARTICLES AND BLANK" should be -- RIGID HINGED-LID PACKAGE OF TOBACCO ARTICLES AND RELATIVE BLANK --.

In the Claims:

At Column 6, line 42, "panel. (19')" should be -- panel (19') --.

At Column 8, line 15, "container, (2)" should be -- container (2) --.

Signed and Sealed this

First Day of May, 2007

JON W. DUDAS
*Director of the United States Patent and Trademark Office*